United States Patent [19]

Andersen

[11] 4,201,496

[45] May 6, 1980

[54] WAVE MAKING MACHINES

[76] Inventor: Per F. Andersen, 58 Kenmount Rd., P.O. Box 8246, St. John's, Newfoundland, Canada, A1B 3N4

[21] Appl. No.: 643

[22] Filed: Jan. 2, 1979

[51] Int. Cl.[2] ..... E02B 15/02; E02B 3/00; E04H 3/20

[52] U.S. Cl. ..... 405/79; 4/172.16

[58] Field of Search ..... 405/79, 52; 4/172.16, 4/178; 272/26, 32

[56] References Cited

U.S. PATENT DOCUMENTS 3,477,233 11/1969 Andersen ..... 405/79

*Primary Examiner*—Alexander Grosz

*Attorney, Agent, or Firm*—Fetherstonhaugh & Co.

[57] ABSTRACT

A machine for making waves on the free surface of a body of liquid comprises a member which is buoyant in the liquid, driving means mounted on and supported above the free surface of the water by the buoyant member to cause a periodic motion thereof relative to the surface of the liquid between a raised position and a lowered position, such relative motion causing substantial variations in the liquid displacement of the buoyant member, said buoyant member comprises a longitudinally elongated wave making plunger, floatation means underlying said wave making plunger for supporting said wave making plunger with its longitudinal extent horizontally disposed at a level with respect to the free surface of the water when in use such that the plunger displacement is substantially zero when in said raised position.

18 Claims, 4 Drawing Figures

WAVE MAKING MACHINES

FIELD OF INVENTION

This invention relates to improvements in wave making machines.

PRIOR ART

U.S. Pat. No. 3,477,233 granted to me in 1969 discloses several alternative constructions for a wave making machine. The present invention provides a wave making machine which has a number of improved features over those disclosed in the aforementioned patent.

I have found that an efficient wave propagation action of the plunger is one in which the plunger displacement is about zero when in its uppermost position during oscillation in use. In order to achieve this desirable effect, I provide floatation tanks which underlie and support the wave forming plunger at the required level of floatation.

A further problem which I have encountered in the wave making is in maintaining the stability of the plunger member. I have found that this difficulty can be substantially overcome by employing an outrigger float which is secured with respect to the plunger and serves to maintain the plunger in an upright configuration as it is displaced relative to the free surface of the liquid.

In U.S. Pat. No. 3,477,233 a backboard is provided so that waves are only propagated in one direction. I have found that there is considerable advantage to be derived from securing the backboard with respect to the plunger so that it moves with the plunger. This facilitates the relocation of the wave making machine as it makes it possible to move the machine without having to separately relocate the backboard.

While each of the improving features discussed in the preceding paragraphs may be independently used to advantage to better the action of the wave making machine of U.S. Pat. No. 3,477,233 the features may also be used to considerable advantage in combination to provide a new wave making machine in which the floatation tanks serve to provide a particular and favourable level of floatation of the floating plunger, the outrigger float provides stability to the floating plunger and the backboard mounted for movement with the plunger facilitates the relocation of the wave making machine and prevents wave propagation in a direction toward the outrigger float leaving wave action to propagate to that side of the backboard only which is remote from the outrigger float.

SUMMARY OF THE INVENTION

According to one aspect of the present invention a machine for making waves on a free surface of a body of liquid comprises a member which is buoyant in the liquid, driving means associated with the buoyant member to cause a periodic motion thereof relative to the surface of the liquid between a raised position and a lowered position, such relative motion causing substantial variations in the liquid displacement of the buoyant member, said buoyant member comprising a longitudinally elongated wave making plunger, floatation means underlying said wave making plunger for support, said wave forming plunger with its longitudinal extent horizontally disposed at a level with respect to the free surface of the water such that, when in use, the plunger displacement is substantially zero when in said raised position.

According to a further aspect of the present invention a machine for making waves on a free surface of a body of liquid comprises a member which is buoyant in the liquid, drive means associated with the buoyant member to cause a periodic motion thereof relative to the surface of the liquid between a raised position and a lowered position, such relative motion causing substantial variations in the liquid displacement of the buoyant member, said buoyant member comprising, a longitudinally elongated wave making plunger adapted to be supported by the body of liquid with its longitudinal extent horizontally disposed at said free surface, a longitudinally elongated outrigger float which is substantially co-extensive with and is spaced laterally from said plunger, bridge means extending between and connecting said plunger and said float member such that said buoyant member will float in a stable configuration in use.

According to yet another aspect of the present invention there is provided a member which is buoyant in the liquid, driving means associated with the buoyant member to cause a periodic motion thereof relative to the surface of the liquid between a raised position and a lowered position such relative motion causing substantial variations in the liquid displacement of the buoyant member, said buoyant member comprising a longitudinally elongated wave making plunger adapted to be supported by the body of liquid with its longitudinal extent horizontally disposed at said free surface, a backboard co-extensive with and arranged in a spaced parallel relationship with said plunger, means connecting said backboard to said plunger for movement therewith such that the position of the backboard with respect to the plunger is unaffected by movement of the plunger and changes in liquid level.

According to a still further aspect of the present invention there is provided a longitudinally elongated wave making plunger, at least one floatation member underlying said plunger and projecting downwardly therefrom at spaced intervals along the length thereof, said floatation members supporting said plunger with its longitudinal extent horizontally disposed at a predetermined level with respect to the free surface in use, a longitudinally elongated outrigger float which is substantially co-extensive with and is arranged in spaced parallel relationship with respect to said plunger, said outrigger float having a longitudinal axis of rotation about which it may oscillate when floating in said liquid, bridge means extending between and connecting said plunger member and said float member such that said plunger is maintained in a stable floating configuration by said float member, drive means associated with said plunger, said drive means being operative to cause periodic motion of said plunger relative to the surface of the liquid in an arc generated from said axis for rotation of said float member.

The invention will be more clearly understood after reference to the following detailed specification read in conjunction with the drawings wherein.

Figure 1:
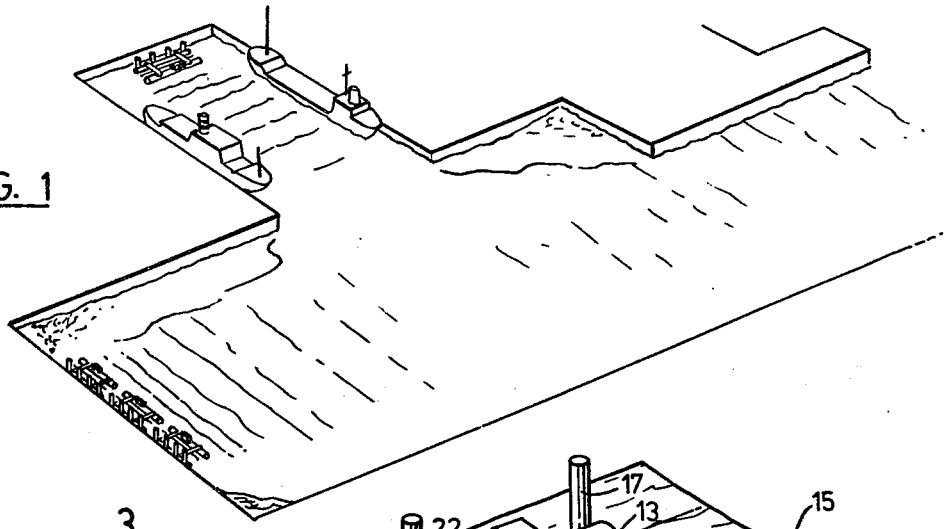
FIG. 1 is a pictorial view illustrating a typical site in which wave making machines may be installed.
Figure 2:
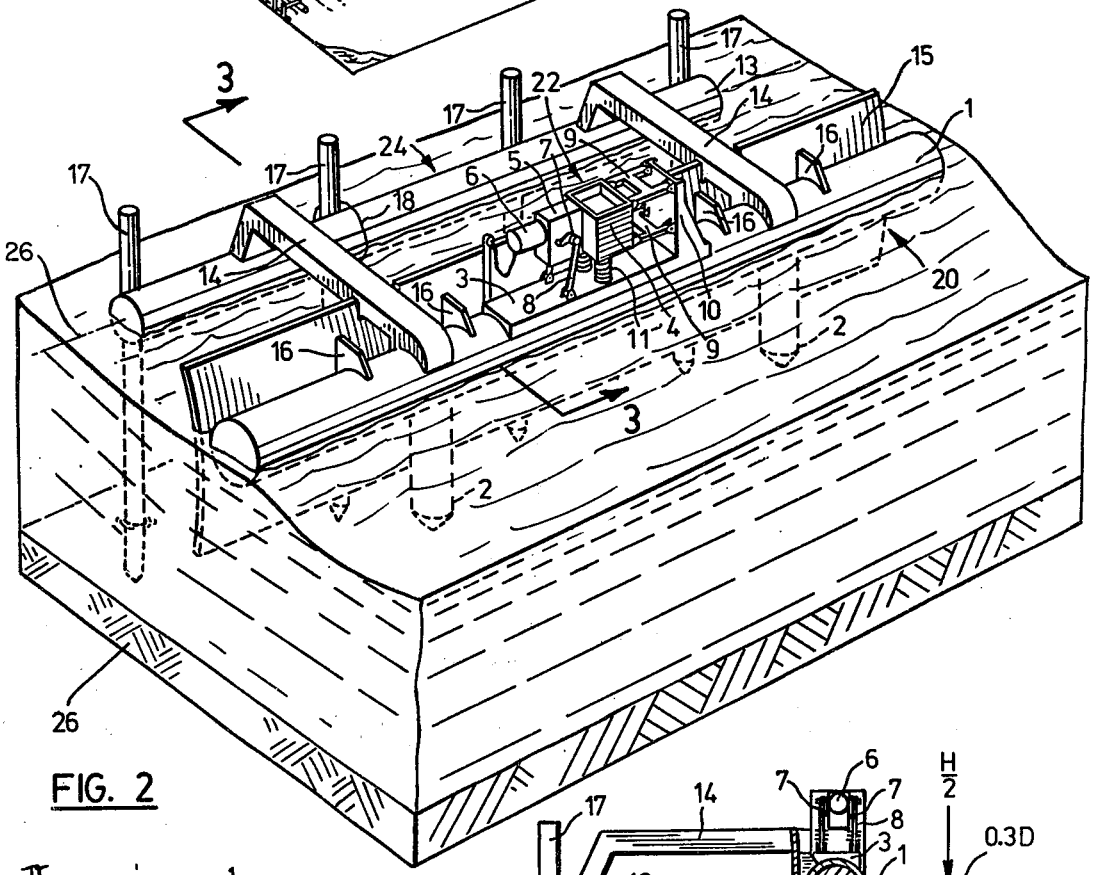
FIG. 2 is a pictorial view of a wave making machine according to an embodiment of the present invention in use.
Figure 4:
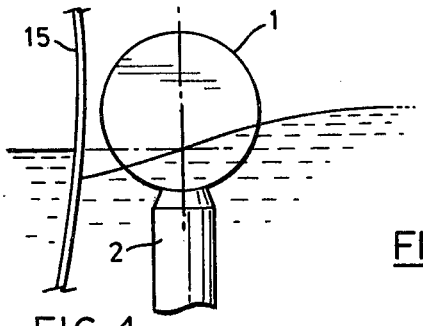
FIG. 4 is an enlarged diagrammatic end view of the elongated wave making plunger and its associated backboard.
Figure 3:
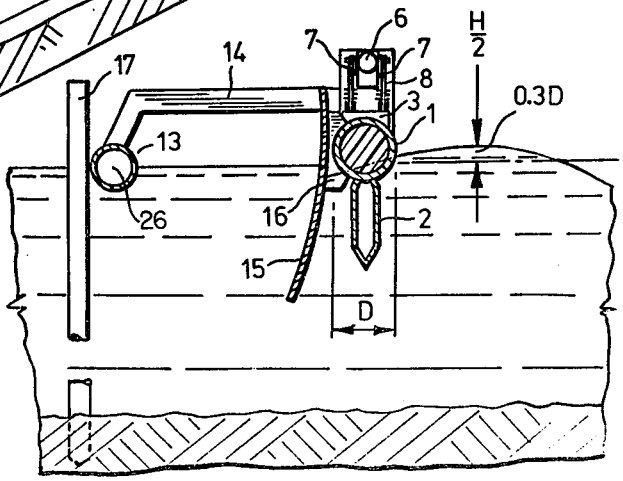
FIG. 3 is a cross-sectional view in the direction 3—3 of FIG. 2.

With reference to the drawings the reference numeral 20 refers generally to a wave making machine constructed in accordance with an embodiment of the present invention. The wave making machine consists of a longitudinally elongated cylindrical shaped wave making plunger 1. The cross-sectional configuration of the plunger 1 is preferably substantially uniform over substantially the full length thereof so that a substantially uniform wave is generated along the length of the plunger in use. A pair of floatation tanks 2 at their upper end secured with respect to the plunger 1 and extend downwardly therefrom at spaced intervals along the length thereof. A base plate 3 is mounted on and extends longitudinally of the plunger 1 centrally of the longitudinal extent thereof. The base plate 3 supports an oscillating drive mechanism generally identified by the reference numeral 22. The oscillating drive mechanism 22 consists of a weighted housing 4 on which a reduction drive box 5 is mounted. The reduction drive box 5 is driven by an electric motor 6 which is mounted thereon for movement therewith. A pair of crank arms 7 extend outwardly from the drive box 5, one on either side thereof. Link arms 8 extend from each crank arm 7 to pivotal connections with the base plate 3. A second pair of link arms 9 are each pivotally mounted at one end on the weighted housing 4 and at the other end on a bracket 10 which extends upwardly from the base plate 3. The weighted housing is supported above the base plate 3 by a pair of compression springs 11.

The wave making plunger 1 and its associated floatation tanks 2 and oscillating drive mechanism 22 are maintained in an upright floating configuration by means of an outrigger assembly generally identified by the reference numeral 24. The outrigger assembly includes an outrigger float 13 and a pair of bridge members 14. The outrigger float 13 is circular in cross-section and has a longitudinal axis of rotation 26. The bridge members 14 are connected to the plunger 1 and the outrigger float 13 and extend above the level of the liquid in which the wave making machine floats in use.

A backboard 15 is supported by a plurality of brackets 16 in a position disposed between the plunger 1 and the outrigger float 13 adjacent to and coextensive with the plunger 1. The backboard 15 is formed with a top to bottom concave arcuate curvature extending in an arc generated from the axis of rotation 26 of the outrigger float 13.

In use, a plurality of piles 17 may be driven into the bed 26 underlying the body of liquid and a cable strap 18 may be used to tether the outrigger float 13 to prevent movement of the wave making machine across the surface of the liquid outside predetermined limits while allowing vertical movement of the wave making machine required to accommodate changes in liquid level.

To generate waves the motor 6 is powered from a suitable souce of electrical power (not shown) to rotatably drive the cranks 7. Rotation of the cranks 7 causes periodic motion of the plunger 1 relative to the surface of the liquid which in turn causes substantial variations in the liquid displacement of the plunger and thereby generates waves in the body of liquid. The outrigger float 13 acts as a floating fulcrum about which the plunger 1 travels in an arc. As previously indicated, the arc of curvature of the backboard 15 is generated from the axis of rotation 26 of the outrigger float with the result that the movement of the back plate 15 does not in itself generate any substantial wave motion and thus the stability of the wave making machine as a whole is not adversely affected by the oscillation motion of the back plate 15. The outrigger float assembly 24 provides for the stable floatation of the machine as a whole in the body of liquid.

The floatation tanks 2 are designed in proportion to provide sufficient buoyancy to the plunger 1 to ensure that it is supported so that its displacement approaches zero when in its raised position during oscillation in use. This provides for the optimum wave making action of the plunger. By employing a plunger of substantially uniform cross-sectional configuration the waves which are generated are of substantially uniform configuration along the length thereof.

It will be noted that the various components of the wave making machine including the plunger 1, floatation tanks 2, bridge member 14, back plate 15, and outrigger float 13 form a rigid structure which will float on the liquid with the plunger and outrigger float partially submerged. As previously indicated, the plunger floatation tanks serve to raise the floatation position of the plunger to an appropriate level critical for efficent wave production.

While the various components of the wave making machine may be made from many suitable material, it has been found that the plunger 1 and outrigger float 13 may be conveniently made from steel tubes which are closed at either end so as to be watertight. Similarly the floatation tanks 2 may be constructed from watertight steel tanks, the ends of the floatation tanks 2 are preferably pointed so as to reduce liquid friction during the operation of the wave machine. For safety against leaks and flooding of the wave machine all of the hollow components may be filled with styrofoam or other light weight foam material. The backboard 15 may be made from steel sheet which may be corrugated ribbed or braced to maintain its rigidity.

It will be apparent that the wave making machine of the present invention may be constructed so as to have any suitable proportions appropriate to the installation in which it is to be used. By way of example and without limiting the scope of the present invention, the plunger may measure five feet in diameter in order to generate waves which are 2 to 3 feet high and 20 to 30 feet in length. In such a construction, the backboard preferably has an overall height of 12 to 14 feet of which about 7 feet is disposed below the water level, five to seven feet disposed above the water level when the wave making machine at rest is floating freely on the surface of the water.

It will be noted that a plunger formed from a steel tube measuring 5 feet in diameter and having a sufficient strength to be driven into the surface of the water without distorting would have a displacement, when floating on the water, which would be greater than that required to provide the optimum wave forming action and it is for this reason that the floatation tanks are provided.

Preferably, the backboard 15 is spaced one foot or so rearwardly from the plunger and the outrigger float 13 is preferably spaced from 20 to 30 feet rearwardly from the plunger. The above proportions are provided in order to give some indication of the relative proportions of the various components, however, it will be understood that a wave making machine constructed in accordance with the present invention may have proportions which may vary greatly corresponding to the installation which has to be used as also the relative proportions of the various components may be varied as required.

In most applications, it is preferable to ensure that the combined weight of the weighted housing and the drive mechanism is significant in relation to the weight of the plunger. Furthermore, the distance between the plunger and outrigger float should preferably exceed three to four time the diameter of the plunger body. In addition, the backboard 15 should extend below the underside of the plunger body a depth of about 1.5 times the diameter of the plunger body. Preferably the diameter D of the plunger body is selected such that it is one and one half to two times the height of the waves which are to be generated The level at which the wave making machine floats when at rest may be adjusted by varying the weight carried by the weighted housing.

Various modifications of the wave making machine of the present invention will be apparent to those skilled in the art. For example, the electric motor 6 may be provided with a variable RPM control so that the rate of oscillations may be varied as required in use. In addition, the level at which the plunger floats may be adjusted by altering the weight content of the weighted housing 4. Alternatively, the floatation tanks 2 may be releasably connected to the plunger 1 so as to be removed and replaced by tanks of different buoyancy as required in use.

It will be apparent that the number of floatation tanks used to achieve the desired floatation level of the plunger may vary from one large tank to several smaller tanks without greatly affecting the efficiency of the wave making. It should also be appreciated that the outrigger float has been shown as a single continuous member lending strength and rigidity to the wave machine, but that the wave machine would function with a plurality of shorter outrigger floats if these were properly aligned and attached by bridge means to the plunger member.

It is general knowledge that waves from a single short wave machine travelling across an unconfined water surface will suffer rapid decline due to wave diffraction whereas waves from a wave machine installation having a total length in excess of 8 to 10 times the length of the waves being produced will suffer only minor height loss during propagation and can be made to travel very great distances. The overall length of any given wave machine installation may be made up of several wave machines as described mounted side by side in a line. The individual wave machines of such an installation should be arranged to produce waves of approximately equal size but need not operate in phase with each other to produce a far reaching train of wave action.

What I claim as my invention is:

1. A machine for making waves on the free surface of a body of liquid comprising:

(a) a member which is buoyant in the liquid, (b) driving means mounted on and supported above the free surface of the water by the buoyant member to cause a periodic motion thereof relative to the surface of the liquid between a raised position and a lowered position, such relative motion causing substantial variations in the liquid displacement of the buoyant member, (c) said buoyant member comprising:

(i) a longitudinally elongated wave making plunger, (ii) floatation means underlying said wave making plunger for supporting said wave making plunger with its longitudinal extent horizontally disposed at a level with respect to the free surface of the water when in use such that the plunger displacement is substantially zero when in said raised position.

2. A machine as claimed in claim 1 wherein said buoyant member further comprises:

(i) a longitudinally elongated outrigger float which is substantially co-extensive with and spaced laterally from said wave forming plunger, (ii) bridge means extending between and connecting said plunger and said float such that said buoyant member will float in a stable configuration in use.

3. A machine as claimed in claim 2 wherein said buoyant member further comprises:

(i) a backboard co-extensive with and arranged in a spaced parallel relationship with respect to said plunger, (ii) means connecting said backboard to said plunger for movement therewith such that the position of the backboard with respect to the plunger is unaffected by the movement of the plunger and changes in liquid level.

4. A machine as claimed in claim 1 wherein said buoyant member further comprises:

(i) a backboard co-extensive with and arranged in a spaced parallel relationship with respect to said plunger, (ii) means connecting said backboard to said plunger for movement therewith such that the position of the backboard with respect to the plunger is unaffected by the movement of the plunger and changes in liquid level.

5. A machine as claimed in claim 1, 3 or 2 including locating means for preventing movement of the buoyant member across the surface of the liquid outside predetermined limits while allowing vertical movement of the buoyant member consequent upon changes in the liquid level.

6. A machine as claimed in claim 1, 3 or 2 wherein said plunger member is circular in cross-section.

7. A machine as claimed in claim 1, 3 or 2 wherein said drive means is in the form of a weight displacement unit mounted on said plunger for movement therewith.

8. A machine for making waves on the free surface of a body of liquid comprising:

(a) a member which is buoyant in the liquid, (b) drive means associated with the buoyant member to cause a periodic motion thereof relative to the surface of the liquid between a raised position and a lowered position, such relative motion causing substantial variations in the liquid displacement of the buoyant member, (c) said buoyant member comprising:

(i) a longitudinally elongated wave forming plunger adapted to be supported by the body of liquid with its longitudinal extent horizontally disposed at said free surface, (ii) a longitudinally elongated outrigger float which is substantially co-extensive with and is spaced laterally from said plunger member, (iii) bridge means extending between and connecting said plunger member and said float member, such that said buoyant member will float in a stable configuration in use.

9. A machine as claimed in claim 8 wherein said buoyant member further comprises:

(i) a backboard co-extensive with and arranged in a spaced parallel relationship with respect to said plunger, (ii) means connecting said backboard to said plunger for movement therewith such that the position of the backboard with respect to the plunger is unaffected by the movement of the plunger and changes in liquid level.

10. A machine as claimed in claim 8, 3 and 2 wherein said outrigger load member is circular in cross-section.

11. A machine as claimed in claim 8, 10 or 2 wherein said bridge means comprises a plurality of arms arranged at spaced intervals along the length of the plunger member and extending between the plunger and the float member at a level thereabout so as to remain above the liquid level in all positions of said plunger.

12. A machine for making waves on the free surface of a body of liquid comprising:

(a) a member which is buoyant in the liquid, (b) driving means associated with the buoyant member to cause a periodic motion thereof relative to the surface of the liquid between a raised position and a lowered position, such relative motion causing substantial variations in the liquid displacement of the buoyant member, (c) said buoyant member comprising, (i) a longitudinally elongated wave forming plunger adapted to be supported by the body of liquid with its longitudinal extent horizontally disposed at said free surface, (ii) a backboard co-extensive with and arranged in a spaced parallel relationship with said plunger, (iii) means connecting said backboard to said plunger for movement therewith such that the position of the backboard with respect to the plunger is unaffected by movement of the plunger and changes in liquid level.

13. A machine for making waves at the free surface of a body of liquid comprising:

(a) a longitudinally elongated wave forming plunger member, (b) at least one floatation member underlying said plunger member and projecting downwardly therefrom, said floatation members supporting said plunger member with its longitudinal extent horizontally disposed at a predetermined level with respect to the free surface in use, (c) a longitudinally elongated outrigger float which is substantially co-extensive with and is arranged in a spaced parallel relationship with respect to said plunger member, said outrigger float having a longitudinal axis of rotation about which it may oscillate when floating in said liquid, (d) bridge means extending between and connecting said plunger member and said float member such that said plunger member is maintained in a stable floating configuration by said float member, (e) drive means associated with said plunger, said drive means being operative to cause periodic motion of said plunger relative to the surface of the liquid in an arc generated from said axis for rotation of said float member.

14. A machine as claimed in claim 13 including locating means for preventing movement of the buoyant member across the surface of the liquid outside predetermined limits while allowing vertical movement of the buoyant member consequent upon changes in the liquid level.

15. A machine as claimed in claim 13 wherein said plunger member is circular in cross-section.

16. A machine as claimed in claim 13 wherein said backboard is one with an arcuate curvature generated from about said centre of rotation of said outrigger float whereby oscillating movement of said backboard with said plunger does not generate any significant wave in a direction toward said outrigger float.

17. A machine as claimed in claim 13 wherein said drive means is in the form of a weight displacement unit mounted on said plunger for movement therewith.

18. A machine for making waves at the free surface of a body of liquid comprising:

(a) a longitudinally elongated wave forming plunger member, (b) a plurality of floatation members underlying said plunger member and projecting downwardly therefrom at spaced intervals along the length thereof, said floatation members supporting said plunger member with its longitudinal extent horizontally disposed at a predetermined level with respect to the free surface in use, (c) a longitudinally elongated outrigger float which is substantially co-extensive with and is arranged in a spaced parallel relationship with respect to said plunger member, said outrigger float having a longitudinal axis of rotation about which it may oscillate when floating in said liquid, (d) bridge means extending between and connecting said plunger member and said float member such that said plunger member is maintained in a stable floating configuration by said float member, (e) a backboard co-extensive with and arranged in a spaced parallel relationship with respect to said plunger member, (f) means connecting said backboard to said plunger member for movement therewith such that the position of the backboard with respect to the plunger is unaffected by the movement of the plunger and changes in liquid level, (g) drive means associated with said plunger, said drive means being operative to cause periodic motion of said plunger relative to the surface of the liquid in an arc generated from said axis for rotation of said float member.

* * * * *